US009914608B2

(12) United States Patent
Conti et al.

(10) Patent No.: US 9,914,608 B2
(45) Date of Patent: Mar. 13, 2018

(54) METHOD AND APPARATUS FOR CONTROLLING THE WINDING OF AN ELONGATED ELEMENT ONTO A COLLECTION REEL WITH THE INTERPOSITION OF A SERVICE FABRIC

(71) Applicant: Pirelli Tyre S.p.A., Milan (IT)

(72) Inventors: Davide Conti, Milan (IT); Francesco Broggi, Milan (IT)

(73) Assignee: PIRELLI TYRE S.P.A., Milan (IT)

( * ) Notice: Subject to any disclaimer, the term of this patent is extended or adjusted under 35 U.S.C. 154(b) by 634 days.

(21) Appl. No.: 14/494,222

(22) Filed: Sep. 23, 2014

(65) Prior Publication Data

US 2015/0129704 A1 May 14, 2015

Related U.S. Application Data

(62) Division of application No. 13/514,241, filed as application No. PCT/IB2010/003322 on Dec. 17, 2010, now Pat. No. 8,871,045.

(Continued)

(30) Foreign Application Priority Data

Dec. 18, 2009 (IT) ..... MI2009A2221

(51) Int. Cl.
*B65H 18/10* (2006.01)
*B65H 23/198* (2006.01)

(Continued)

(52) U.S. Cl.
CPC ..... *B65H 18/10* (2013.01); *B65H 19/2207* (2013.01); *B65H 23/06* (2013.01);

(Continued)

(58) Field of Classification Search
CPC .... B65H 18/10; B65H 23/198; B65H 23/195; B65H 29/008; B65H 23/06;

(Continued)

(56) References Cited

U.S. PATENT DOCUMENTS 1,611,400 A 12/1926 Andrews
2,991,950 A 7/1961 Peter (Continued)

FOREIGN PATENT DOCUMENTS

CN 101407127 A 4/2009
DE 3513238 10/1986

(Continued)

OTHER PUBLICATIONS

Dudzinski, M., Understanding Center-Driven Web Winders, Motion System Design (Apr. 2000).

(Continued)

*Primary Examiner* — William A. Rivera
(74) *Attorney, Agent, or Firm* — Finnegan, Henderson, Farabow, Garrett & Dunner, L.L.P.

(57) ABSTRACT

An apparatus for winding an elongated element onto a collection reel with the interposition of a service fabric, includes a device for feeding the elongated element toward the collection reel, a device for feeding the service fabric toward the collection reel, a device for driving in rotation the collection reel, and a control device for controlling the rotation speed of the collection reel. The control device includes a device for detecting the actual winding diameter of the collection reel and a device for adjusting the rotation speed of the collection reel according to the actual winding diameter of the collection reel.

45 Claims, 5 Drawing Sheets

Related U.S. Application Data

(60) Provisional application No. 61/282,308, filed on Jan. 19, 2010.

(51) Int. Cl.
*B65H 19/22* (2006.01)
*B65H 23/06* (2006.01)
*B65H 23/195* (2006.01)
*B65H 29/00* (2006.01)

(52) U.S. Cl.
CPC ..... *B65H 23/195* (2013.01); *B65H 23/198* (2013.01); *B65H 29/008* (2013.01); *B65H 2301/41524* (2013.01); *B65H 2301/414324* (2013.01); *B65H 2511/142* (2013.01); *B65H 2513/10* (2013.01); *B65H 2515/314* (2013.01); *B65H 2801/93* (2013.01)

(58) Field of Classification Search
CPC ..... B65H 19/2207; B65H 2301/41524; B65H 2513/10; B65H 2515/314; B65H 2801/93; B65H 2301/414324; B65H 2511/142
See application file for complete search history.

(56) References Cited

U.S. PATENT DOCUMENTS

| | | | | |
|---|---|---|---|---|
| 3,225,988 | A | 12/1965 | Drenning | |
| 3,455,764 | A | 7/1969 | Bryant | |
| 3,701,493 | A | 10/1972 | Welsch et al. | |
| 3,827,844 | A | 8/1974 | Frey et al. | |
| 4,139,164 | A | 2/1979 | Alfio | |
| 4,170,504 | A | 10/1979 | Riggs | |
| 4,181,270 | A | 1/1980 | Laar et al. | |
| 4,445,044 | A | 4/1984 | Buess | |
| 4,491,283 | A | 1/1985 | Pav et al. | |
| 4,821,634 | A | 4/1989 | Swanson | |
| 4,848,697 | A | 7/1989 | Skalleberg | |
| 5,282,584 | A | 2/1994 | Yano | |
| 5,516,058 | A | 5/1996 | Omokawa et al. | |
| 5,950,956 | A | 9/1999 | Yukitake | |
| 6,402,077 | B1 | 6/2002 | Vargo et al. | |
| 6,536,702 | B1 | 3/2003 | Vargo et al. | |
| 6,557,795 | B1 * | 5/2003 | Ohshio | B65H 16/06 242/528 |
| 6,755,370 | B2 * | 6/2004 | Volpi | B29C 31/00 242/528 |
| 8,871,045 | B2 * | 10/2014 | Conti | B65H 19/2207 156/110.1 |
| 2002/0113160 | A1 | 8/2002 | Niioka et al. | |
| 2003/0001036 | A1 | 1/2003 | Beavers et al. | |
| 2006/0130961 | A1 | 6/2006 | Byrne et al. | |
| 2008/0277523 | A1 * | 11/2008 | Delmore | B65H 18/00 242/536 |
| 2012/0248651 | A1 * | 10/2012 | Conti | B65H 19/2207 264/299 |
| 2016/0311638 | A1 * | 10/2016 | Minato | B65H 23/1888 |

FOREIGN PATENT DOCUMENTS

| | | |
|---|---|---|
| EP | 0 649 807 A2 | 4/1995 |
| GB | 882503 | 11/1961 |
| JP | 49-012901 | 3/1974 |
| JP | 61-254456 | 11/1986 |
| JP | 09-240893 | 9/1997 |
| KR | 10-0769644 | 10/2007 |
| SU | 1004237 A1 | 3/1983 |
| WO | WO 99/64335 A1 | 12/1999 |

OTHER PUBLICATIONS

English-language Abstract of CN 101407127A (original document dated Apr. 2009).
English-language Abstract of JP 61-254456 (original document dated Nov. 1986).
English-language Abstract of KR 10-076944 (original document dated Oct. 2007).
English-language translation of KR 10-076944 (original document dated May 2004).
English-language translation of Notification of the First Office Action issued by the State Intellectual Property Office of the People's Republic of China dated Apr. 3, 2014 in corresponding Application No. CN 201080057383.6 (6 pages).
International Search Report from the European Patent Office for corresponding International Application No. PCT/IB2010/003322, dated May 18, 2011.
Koehler, C., Center Driven Winder Basics for the Rubber Industry, IEEE Industry Applications Conference (1995).
Machine-generated English-language translation of DE 3513238 (original document dated Oct. 1986).
Machine-generated English-language translation of JP 09-240893 (original document dated Sep. 1997).
Notification of the First Office Action issued by the State Intellectual Property Office of the People's Republic of China dated Apr. 3, 2014 in corresponding Application No. CN 201080057383.6 (5 pages).
Decision on Grant Patent for Invention dated Mar. 18, 2015 in corresponding Russian Patent Application No. RU 2012130418/13(047810) (12 pages).
English-language translation of Decision on Grant Patent for Invention dated Mar. 18, 2015 in corresponding Russian Patent Application No. RU 2012130418/13(047810) (7 pages).

* cited by examiner

METHOD AND APPARATUS FOR CONTROLLING THE WINDING OF AN ELONGATED ELEMENT ONTO A COLLECTION REEL WITH THE INTERPOSITION OF A SERVICE FABRIC

CROSS REFERENCE TO RELATED APPLICATIONS

This application is a division of U.S. application Ser. No. 13/514,241, filed Jun. 6, 2012, which is a national phase application based on PCT/IB2010/003322, filed Dec. 17, 2010, and claims the priority of Italian Patent Application No. MI2009A002221, filed Dec. 18, 2009, and the benefit of U.S. Provisional Application No. 61/282,308, filed Jan. 19, 2010, the content of all of which is incorporated herein by reference.

BACKGROUND OF THE INVENTION

Field of the Invention

The present invention relates to a method and an apparatus for controlling the winding of an elongated element onto a collection reel with the interposition of a service fabric.

Description of the Related Art

The elongated element of the present invention, in particular, is an element made of elastomeric material obtained through a conventional drawing process. Such elongated element is, for example, adapted to be used in a process for the manufacturing of a tyre for vehicle wheels, in particular for making the sidewalls and/or the tread band and/or other tyre components made of elastomeric material.

Once drawn and prior to be used in the building of the tyre, the elongated element is wound on a specific collection reel. Such winding typically takes place in line with the drawing process.

As known, due to the stickiness imparted to the elongated element by the elastomeric material which it consists of, the winding of the elongated element onto the collection reel requires the simultaneous winding of a service fabric onto the collection reel. Such service fabric is interposed between the overlapped coils of the elongated element right in order to prevent the reciprocal sticking of such coils.

The service fabric is taken from a storage coil and is intended to be removed from the elongated element prior to the final use of the latter. The winding of the elongated element onto the collection reel takes place at the same time as that of the service fabric.

Throughout the present description, unless otherwise indicated, and in the subsequent claims, "elongated element" is used to indicate an element of elastomeric material having a main extension along a longitudinal direction thereof. Such elongated element preferably consists of elastomeric material only but it may also comprise textile or metal reinforcing cords incorporated in a matrix of elastomeric material.

Throughout the present description and in the subsequent claims, the definitions "upstream" and "downstream" are referred, unless otherwise indicated, to the feeding direction of the elongated element towards the collection reel.

Throughout the present description and in the subsequent claims, the expression "initial winding diameter" of the collection reel is used to indicate the outer diameter of the collection reel prior to the winding of the elongated element. Such diameter corresponds to the outer diameter of the reel core increased by the thickness of the layers of service fabric that are wound onto the collection reel before winding of the elongated element begins. Such thickness corresponds to the thickness of the service fabric when the initial winding of the service fabric onto the collection reel does not provide for the making of overlapped coils of service fabric, or to the thickness of the service fabric multiplied by the number of overlapped coils when the initial winding of the service fabric onto the collection reel provides for the making of overlapped coils of service fabric.

The expression "actual winding diameter" of the collection reel, on the other hand, is used to indicate the outer diameter of the collection reel at the instant in which it is detected. Such diameter corresponds to the outer diameter of the core of the collection reel increased by the thickness of the overlapped coils of elongated element and service fabric provided onto the collection reel when detection is carried out.

Consistently, "actual unwinding diameter" of the storage reel is used to indicate the outer diameter of the reel from which the service fabric is withdrawn at the moment in which it is detected. Such diameter corresponds to the outer diameter of the core of such reel increased by the thickness of the coils of service fabric provided onto such reel when detection is carried out.

GB 882,503 describes an apparatus for the simultaneous winding of an elongated element and of a service fabric onto a collection reel. The elongated element comprises reinforcing cords incorporated into a matrix of elastomeric material. Such element is used for making the carcass plies of a tyre. The apparatus comprises a feeding device of the elongated element towards the collection reel and a feeding device of the service fabric towards said collection reel. Rotation of the collection reel causes simultaneous winding of the elongated element and of the service fabric onto the collection reel. The service fabric, in particular, interposes between the overlapped coils of the elongated element.

SUMMARY OF THE INVENTION

The Applicant observed that using an apparatus as the one described above may result in an irregular or uneven winding of the elongated element onto the collection reel. The Applicant has noted that, in such circumstances, there is the risk of generating waste production materials and/or defects in the tyre being built.

The Applicant further observed that, by an apparatus of the type described above, there may be an irregular or uneven winding of the fabric service as well. In this case, there is the risk of having a localised sticking of the overlapped coils of the elongated element wound onto the collection reel, with consequent deterioration of the same elongated element.

The Applicant believes that the uneven winding of the elongated element and of the service fabric onto the collection reel is essentially caused by the fact that, during winding, some parameters that identify the actual winding conditions change. Such parameters are, for example, the winding diameter of the collection reel, the length of elongated element about to be deposited onto the collection reel, the advancing speed of the elongated element, the thickness of the elongated element, the tension of the service fabric, etc.

The Applicant believes that the uneven winding of the elongated element onto the collection reel is caused, moreover, by the release of residual tensions in the elongated element. Such release of tensions may be caused, for example, by temperature variations undergone by the same elongated element.

The Applicant has realized that, in order to evenly wind the elongated element and the service fabric with no residual tensions onto the collection reel, it is necessary to detect the actual winding conditions instant by instant and instantaneously adjusting the winding speed and tension of the elongated element and of the service fabric based on the detected actual winding conditions.

The Applicant has then perceived that, in order to obtain the above, it is necessary to determine the actual winding diameter of the collection reel.

The Applicant has then found that by adjusting the rotation speed of the collection reel according to the actual winding diameter of the collection reel it is advantageously possible to obtain a winding of the elongated element onto the same collection reel which is even and free from residual tensions. In this way, the risk of generating waste production materials and/or creating defects in the final product wherein such elongated element shall be used is prevented.

Therefore, in a first aspect thereof, the present invention relates to a method for controlling the winding of an elongated element onto a collection reel with the interposition of a service fabric, the method comprising:

rotating a collection reel;

simultaneously winding the elongated element and the service fabric onto the collection reel, wherein said simultaneous winding comprises:

determining the actual winding diameter of the collection reel;

adjusting the rotation speed of the collection reel according to said actual winding diameter of the collection reel.

According to the Applicant, the winding of the elongated element and of the service fabric onto the collection reel is thus controlled, instant by instant, based on the actual winding conditions. An even and free from residual tensions winding is thus obtained.

In a second aspect thereof, the present invention relates to an apparatus for winding an elongated element onto a collection reel with the interposition of a service fabric, the apparatus comprising a first work station including:

a device for feeding the elongated element towards a collection reel;

a device for feeding the service fabric towards said collection reel;

a device for driving in rotation said collection reel; a device for controlling the rotation speed of said collection reel;

wherein said control device comprises:

a device for detecting the actual winding diameter of said collection reel;

a device for adjusting the rotation speed of said collection reel according to said actual winding diameter of the collection reel.

Advantageously, such apparatus allows the method described above to be carried out, thus allowing the advantageous results mentioned above to be achieved.

The present invention, in at least one of the above aspects thereof, can comprise at least one of the following preferred features, taken individually or in combination with the others.

In a preferred embodiment of the present invention, the simultaneous winding of the elongated element and of the service fabric onto the collection reel further comprises:

detecting a variation in length of the portion of elongated element about to be deposited onto the collection reel;

adjusting the rotation speed of the collection reel also according to the variation in length of said portion of elongated element.

The Applicant has noted that, in this way, it is possible to prevent any unevenness or irregularities in the winding of the elongated element and of the service fabric due, for example, to a variation in the elongated element thickness or to a variation in the relative position of the collection coil with respect to the feeding direction of the elongated element, or also to the elasticity of the core of the collection reel whereon some layers of elongated element have already been wound. Moreover, the detection of the variation in length of the portion of elongated element about to be deposited onto the collection reel provides for a useful visual indication of the presence of a minimum tension applied to the elongated element during the winding thereof onto the collection reel. The lack of such minimum tension would in fact cause the "drop" of the elongated element on the collection reel, with the consequent risk of creating creases.

Advantageously, detecting the variation of said length allows controlling the tensioning of the elongated element, thus preventing said drop.

Preferably, the elongated element is fed towards the collection reel with a known initial feeding speed, the collection reel having a known initial winding diameter.

Preferably, the collection reel is moved with an initial rotation speed which is determined according to said initial feeding speed of the elongated element and to said initial winding diameter of the collection reel.

Preferably, the service fabric is pulled on the collection reel by rotating the collection reel.

According to a preferred embodiment of the present invention, the actual winding diameter of the collection reel is determined through detection of the instantaneous peripheral speed of the collection reel.

Preferably, the instantaneous peripheral speed of the collection reel is determined through detection of the instantaneous linear speed of the service fabric.

In fact, the Applicant observed that it is possible to consider the service fabric as inextensible and being such service fabric pulled on the collection reel by the rotation of the collection reel, the linear speed of the service fabric corresponds, instant by instant, to the peripheral linear speed of the collection reel. It is thus possible to know the instantaneous value of the latter by detecting the linear speed of the service fabric instant by instant.

Preferably, the elongated element is fed onto the collection reel through at least one conveyor belt which is driven with an instantaneous feeding velocity.

Preferably, the present invention provides for detecting the speed variation of the elongated element instant by instant upstream of said at least one conveyor belt.

In a preferred embodiment of the present invention, the instantaneous feeding speed of said at least one conveyor belt is determined according to the instantaneous speed of the elongated element upstream of said at least one conveyor belt. In this way, it is possible to synchronise the feeding speed of the elongated element onto the collection reel instant by instant with the speed of the process carried out upstream of said conveyor belt (typically, it is a drawing process of the elongated element), so as to allow the method of the present invention to be carried out in line with the above process.

Preferably, the present invention provides for controlling the relative position of said at least one conveyor belt with respect to the collection reel.

More preferably, said control is actuated according to the actual winding diameter of the collection reel. Even more preferably, said control comprises moving said at least one conveyor belt along a feeding direction of the elongated element.

Such device allows keeping the relative position of the conveyor belt with respect to the collection reel constant, making at each instant the point at which the elongated element starts winding onto the collection reel to coincide with the point at which the service fabric starts winding onto the collection reel.

In a preferred embodiment of the present invention, the instantaneous feeding speed of said at least one conveyor belt is adjusted according to the movement of said least one conveyor belt with respect to the collection reel. Such a provision advantageously allows keeping the length of the free portion of elongated element projecting from the conveyor belt constant as the winding diameter of the collection reel varies. In this way it is possible to keep the detection conditions of the variation in length of the portion of elongated element about to be deposited onto the collection reel constant. Moreover, in this way it is possible to limit the occurrence of unevenness or irregularities in the winding of the elongated element onto the collection reel due to twists or deviations of the elongated element caused by the release of internal residual tensions at the aforementioned free portion of elongated element.

In the preferred embodiments of the present invention, the elongated element is fed through a first conveyor belt arranged close to the collection reel and a second conveyor belt operatively arranged between said first conveyor belt and the collection reel. Preferably, said second conveyor belt is moved between a rest position in which a tail end of said second conveyor belt is at a distal position from the collection reel and an operative position in which said tail end is at a proximal position to the collection reel.

Such a provision allows moving as much as possible during deposition the conveyor belt close to the collection reel, thus limiting as much as possible the extension of the free portion of elongated element about to be deposited onto the collection reel and, consequently, reducing the risk of occurrence of the above-discussed twists or deviations.

Preferably, the service fabric is withdrawn from a storage reel.

Preferably, the present invention provides for detecting the instantaneous rotation speed of the storage reel and determining the actual unwinding diameter of the storage reel according to the instantaneous rotation speed of the storage reel and to the instantaneous linear speed of the service fabric.

Preferably, the tension applied to the service fabric is controlled as the actual winding diameter of the collection reel varies. More preferably, said tension control comprises adjusting, instant by instant, the torque generated by a braking force applied to the storage reel.

Preferably, said braking force is actuated by driving in rotation the storage reel in an opposite way with respect to the rotation given by the collection reel.

Advantageously, in this way it is possible to adjust the tension provided to the service fabric during the winding onto the collection reel as desired, besides rotating the storage reel for partially or totally recovering the service fabric.

Preferably, the present invention provides for adjusting, instant by instant, the relative position of the collection reel and of the storage reel.

In a preferred embodiment of the present invention, said adjustment comprises detecting the instantaneous position of the service fabric with respect to the collection reel along a first direction perpendicular to the feeding direction of the elongated element towards the collection reel and moving the storage reel along said first direction. Advantageously, in this way it is possible to automatically manage the reciprocal positioning between service fabric and collection reel as the winding advances, keeping a desired pulling direction of the service fabric, preventing misalignment that would presumably result in undesired creases or deformations on board of the collection reel.

Preferably, the method of the present invention provides for detecting the passage of a tail end of said elongated element during its movement towards the collection reel. This allows automatically managing the completion of the winding of the elongated element and of the service fabric onto the collection reel.

Preferably, the method according to the present invention provides for moving said second conveyor belt in a direction opposite the feeding direction of the elongated element. This solution allows managing the completion of the winding of the elongated element preventing undesired creases or deformations on board of the collection reel.

In a preferred embodiment thereof, the method of the present invention comprises:

completing the winding of the elongated element onto a first collection reel;

winding the elongated element onto a second collection reel with the interposition of a service fabric taken from a second storage reel, said second collection reel and second storage reel being arranged downstream of said first collection reel with respect to the feeding direction of the elongated element;

wherein the winding of the elongated element onto the second collection reel comprises:

feeding the elongated element towards the second collection reel by-passing said first collection reel.

In this way it is possible to wind the elongated element and the service fabric onto the second collection reel while the operations of collection and discharge of the first collection reel are carried out. An advantageous optimisation of the process time is thus obtained.

In a particularly preferred embodiment thereof, the method of the present invention comprises assembling at least one semi-finished product on a forming support to manufacture a tyre for vehicle wheels, wherein such a semi-finished product is obtained from said elongated element unwound from said collection reel.

According to a preferred embodiment of the present invention, the device for controlling the rotation speed of the collection reel further comprises:

a device for detecting a variation in length of a portion of elongated element about to be deposited onto said collection reel;

the rotation speed of the collection reel also being based on the variation in length of said portion of elongated element. The advantages mentioned above are thus obtained.

Preferably, the device for detecting the actual winding diameter of the collection reel comprises a device for detecting the instantaneous peripheral speed of said collection reel.

Preferably, said device for detecting the instantaneous peripheral speed of the collection reel comprises a device for detecting the instantaneous linear speed of the service fabric.

In a preferred embodiment of the present invention, said detection device comprises an encoder associated with at least one roller adapted to deviate the service fabric towards said collection reel. Advantageously, the encoder allows detecting the instantaneous speed of the service fabric, corresponding to the peripheral speed of the collection reel, so that knowing the actual rotation speed of the collection reel it is possible to calculate the instantaneous winding diameter thereof.

Preferably, said feeding device of the elongated element comprises a first conveyor belt arranged close to said collection reel.

More preferably, at least one device for detecting the variation of the advancing speed of the elongated element is provided upstream of said first conveyor belt.

Preferably, said first work station further comprises a device for controlling the relative position of said first conveyor belt with respect to said collection reel.

Preferably, said control device comprises a device for driving the movement of said first conveyor belt along a feeding direction of the elongated element.

Preferably, said driving device is operatively connected to said device for detecting the actual winding diameter of the collection reel. Advantageously, the movement of the first conveyor belt along the feeding direction of the elongated element takes place according to the actual diameter of the collection reel. Such a provision allows keeping the length of the free portion of elongated element projecting from the conveyor belt constant as the winding diameter of the collection reel varies, achieving the advantages discussed above.

Preferably, said first work station further comprises a device for adjusting the speed of said first conveyor belt.

Preferably, said adjustment device is operatively connected to said device for detecting the variation of the advancing speed of the elongated element. Advantageously, it is thus possible to carry out the method of the present invention in line with the process (typically a drawing process) carried out upstream of the aforementioned conveyor belt.

In a preferred embodiment of the present invention, said device for feeding the elongated element further comprises a second conveyor belt operatively arranged between said first conveyor belt and said collection reel.

Preferably, said second conveyor belt is movable between a rest position in which a tail end of said second conveyor belt is at a distal position from the collection reel and an operative position in which said tail end is at a proximal position to the collection reel.

Preferably, said second conveyor belt is pivoted at a tail end of said first conveyor belt.

In a preferred embodiment of the present invention, said first work station comprises an actuator adapted to drive the movement of said second conveyor belt towards and/or from said collection reel. Such movement may therefore take place automatically, with consequent clear advantages from the operating point of view.

In a particularly preferred embodiment of the present invention, said second conveyor belt comprises two parallel belts which can be moved towards/away from one another. Advantageously, it is possible to adjust the relative position of the two parallel belts according to the width of the collection reel, the width of the elongated element and the number of axially adjacent coils of elongated element to be obtained onto the collection reel. The use of two parallel belts further allows simultaneously winding onto a single collection reel of two different elongated elements having a mirror-like arrangement with respect to the centre line of the input belt.

Preferably, an actuator adapted to adjust the relative position of said two parallel belts is provided. Such adjustment may therefore take place automatically, this implying clear advantages from the operating point of view.

In an alternative embodiment of the present invention, the second conveyor belt comprises a single belt whose working position is the closest possible to the collection reel to minimise the free portion of elongated element about to be deposited.

Preferably, said device for detecting a variation in length of the portion of elongated element about to be deposited onto the collection reel is arranged downstream of said second conveyor belt. Even more preferably, the above detection device is pivoted at a tail end of said second conveyor belt.

Preferably, the above detection device comprises at least one potentiometer. As an alternative, the above detection device comprises at least one sensor.

Preferably, said first work station further comprises at least one actuator which is active on said detection device to counterbalance the weight of the detection device and of the portion of elongated element weighing onto said detection device.

Advantageously, the use of said actuator allows keeping a minimum value of tension applied to the elongated element, preventing it from "dropping" on the collection reel, this implying the risk of creating creases in the winding of the elongated element.

In the preferred embodiments of the present invention, the service fabric is taken from a storage reel by rotating said collection reel. Preferably, said first work station further comprises a device for controlling the rotation of said storage reel.

Preferably, said control device comprises a device for detecting the instantaneous rotation speed of the storage reel and, more preferably, also a braking device which is active on said storage reel.

In the preferred embodiments of the present invention, said braking device comprises a motor adapted to apply to said storage reel a rotation in an opposite way with respect to the rotation applied by said collection reel. In an alternative embodiment of the present invention, said braking device comprises a motor adapted to apply to said storage reel a rotation in the same direction, but at a lower speed, with respect to the rotation applied by said collection reel.

In a preferred embodiment of the present invention, said first work station comprises a device for adjusting the relative position of said collection reel and said storage reel.

Preferably, said adjustment device comprises a device for detecting the instantaneous position of the service fabric with respect to the collection reel along a first direction perpendicular to the feeding direction of the elongated element and a device for moving said storage reel along said first direction.

Preferably, said detection device comprises at least one sensor adapted to detect the position of a side edge of the service fabric. Undesired misalignments between the service fabric and the collection reel are thus prevented, reducing the risk of forming-creases on the collection reel.

In the preferred embodiments of the present invention, said first work station further comprises a device for detecting the passage of a tail end of said elongated element during its movement towards said collection reel.

Preferably, said detection device comprises at least one sensor and one roller active in thrust towards a detection surface of said at least one sensor. Advantageously, the passage of the tail end of the elongated element is detected in real time by the signal generated by the sensor upon the direct contact on the latter by the above roller. This allows automatically managing the completion of the winding of the elongated element onto the collection reel.

In a particularly preferred embodiment thereof, the apparatus of the present invention comprises at least one second work station substantially identical to the first work station and arranged downstream of said first work station with reference to the feeding direction of the elongated element.

Preferably, a device for driving the movement of the first conveyor belt of the second work station towards and from the first conveyor belt of the first work station is provided. Such device allows feeding the elongated element alternately on the collection reel of the first work station or on the collection reel of the second work station, allowing the collection and the discharge of a collection reel while the elongated element and the service fabric are wound on the other collection reel.

BRIEF DESCRIPTION OF THE DRAWINGS

Further features and advantages of the present invention will appear more clearly from the following detailed description of some preferred embodiments of an method and apparatus according to the present invention, made with reference to the annexed drawings. In such drawings.

DETAILED DESCRIPTION OF THE INVENTION

Figure 1:
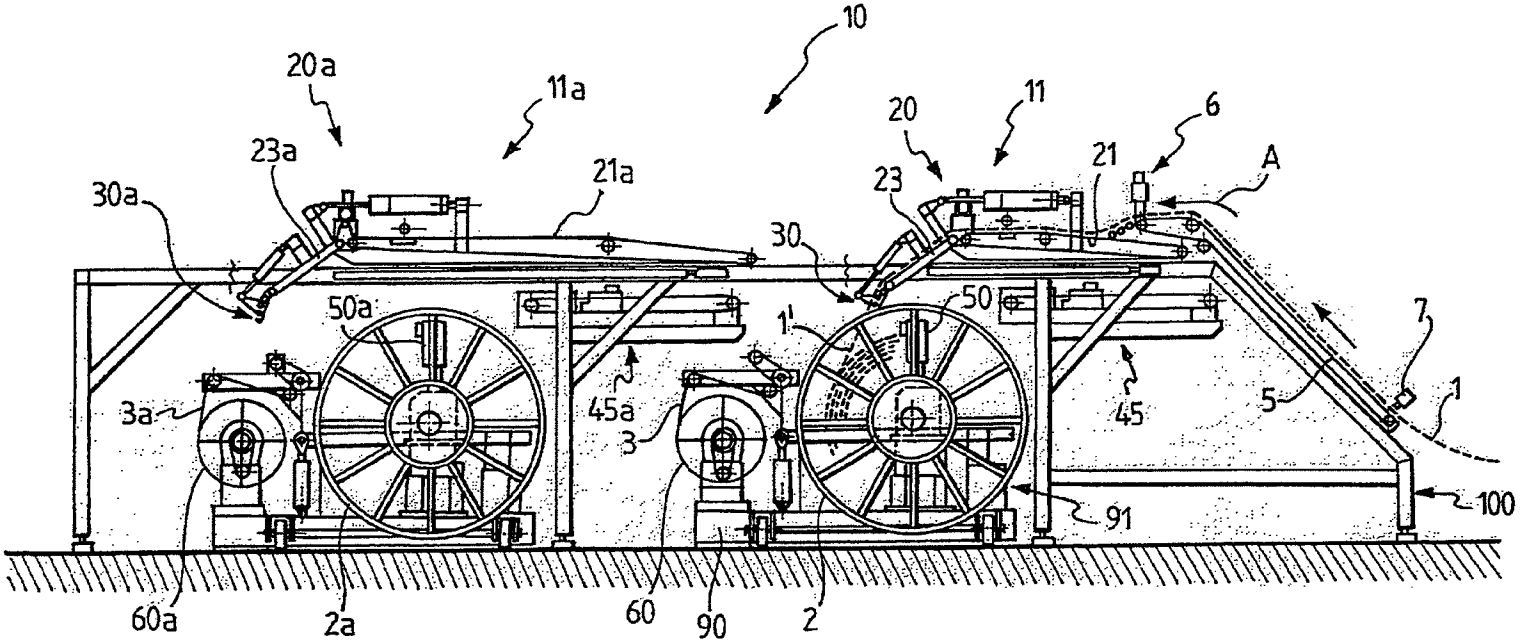
FIG. 1 is a schematic view of an apparatus according to the present invention, such apparatus being shown in a first operating configuration thereof.

In FIG. 1, an exemplary embodiment of an apparatus for depositing an elongated element 1 onto a collection reel 2 with the interposition of a service fabric 3 is globally indicated with reference numeral 10.

Such apparatus 10 is used, in particular, in a process for building a tyre for vehicle wheels, in association with other apparatuses. Such process is intended, in particular, for making the side walls and/or the tread band and/or other tyre components of elastomeric material.

The elongated element 1 is an elongated element of elastomeric material obtained through a conventional drawing process. The drawing process is carried out upstream of apparatus 10 and, preferably, in line with the winding carried out by apparatus 10.

When the elongated element 1 is used for making the side walls of the tread band of a tyre for vehicle wheels, such elongated element 1 preferably has a minimum thickness of 3 mm, more preferably comprised between 4 mm and 15 mm, and a width preferably comprised between 60 mm and 320 mm.

Apparatus 10 comprises two work stations respectively indicated with reference numeral 11 and 11*a*. The two work stations 11, 11*a* are substantially identical (except for some construction details that shall appear clearly hereinafter in the present description) and are arranged one downstream of the other with reference to the feeding direction of the elongated element 10 (such direction is indicated in FIG. 1 with arrow A).

Throughout the present description, the work station 11 shall be described in detail, it being understood that the work station 11*a* has the same structural components as station 11, unless otherwise said.

As schematically indicated in FIG. 1, upstream of the work station 11 there is provided an input belt 5 intended to bring the elongated element 1 from the drawing devices (not shown) provided upstream of apparatus 10 towards the latter.

The movement of the input belt 5 is controlled by a specific motor group 6.

A plurality of photocells 7 is positioned on the input belt 5, preferably four (or other conventional presence sensor/s), adapted to detect the advancing speed variation of the elongated element 1 upstream of the work station 11.

The work station 11 of apparatus 10 comprises a device 20 for feeding the elongated element 1 towards the collection reel 2.

Figure 2:
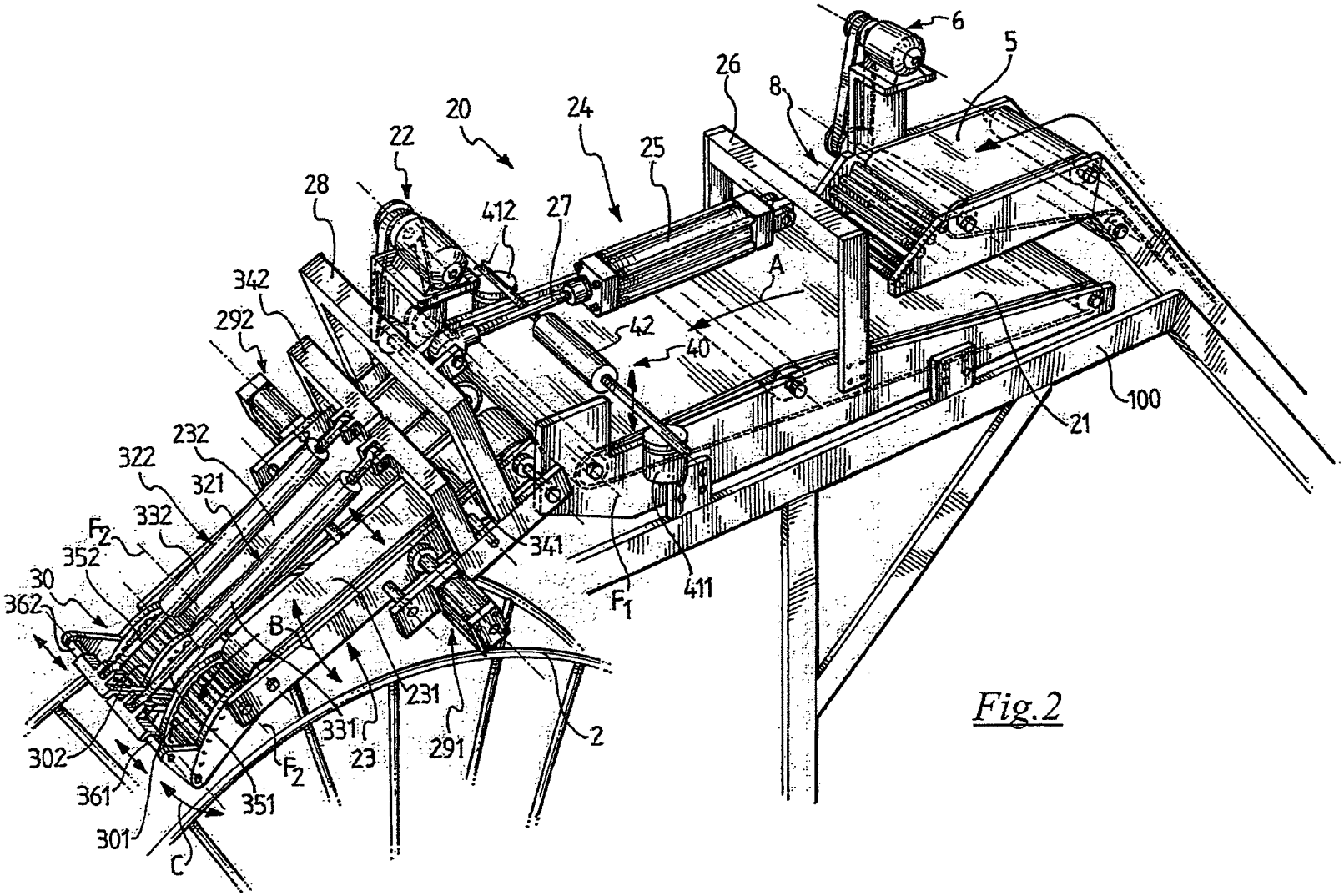
FIG. 2 is a schematic perspective view of a first portion of the apparatus of FIG. 1.
Figure 3:
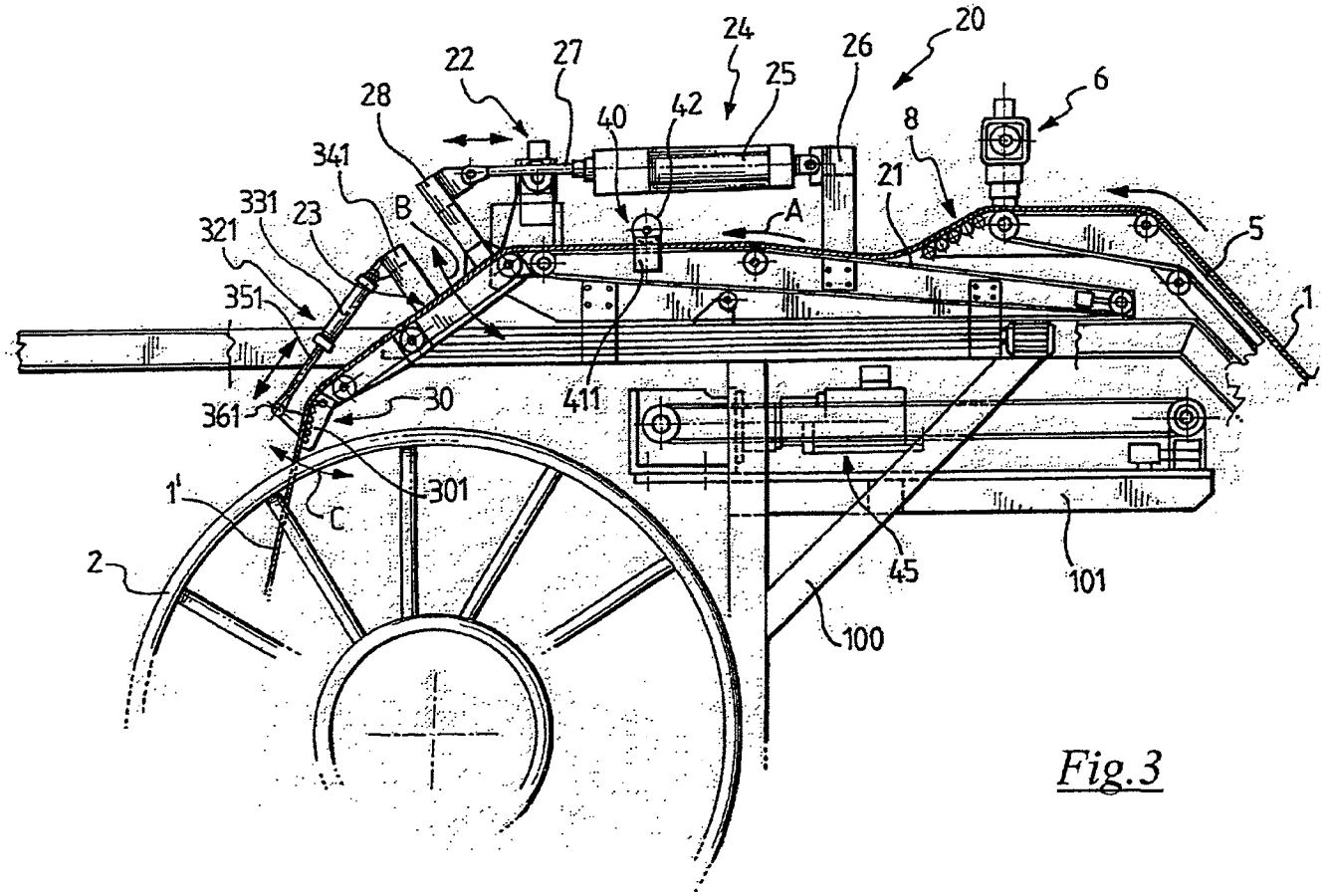
FIG. 3 is a schematic side view of the portion of apparatus of FIG. 2.

As better shown in FIGS. 2 and 3, the feeding device 20 comprises a first conveyor belt 21 arranged downstream of the input belt 5 and close to the collection reel 2 with reference to the feeding direction of the elongated element 1.

The input belt 5 and the conveyor belt 21 are both mounted on a support frame 100.

The tail portion of the input belt 5 is at least partly overlapped to the head portion of the conveyor belt 21 so as to allow the passage of the elongated element 1 from the input belt 5 to the conveyor belt 21. Such passage takes place through the aid of a plurality of rollers (generally indicated with reference numeral 8) suitably arranged downstream of the tail portion of the input belt 5.

The movement of the conveyor belt 21 is controlled by a specific motor group 22.

As shall appear clearly in the following of the present description, the speed of the conveyor belt 21 is adjusted according to the advancing speed of the elongated element 1 upstream of the conveyor belt 21, the latter speed being calculated upon detection of a difference in the advancing speed of the elongated element 1 through the photocells 7.

A second conveyor belt 23 is arranged between the first conveyor belt 21 and the collection reel 2. The movement of conveyor belt 23 is controlled by the same motor group 22 adapted to control the movement of the first conveyor belt 21.

The conveyor belt 23 is pivoted about an axis Fi (FIG. 2) defined at a tail end of the conveyor belt 21. The conveyor belt 23 can thus oscillate between a rest position wherein a tail end thereof is at a distal position from the collection reel 2 (such position being shown in FIG. 5) and an operating position wherein said tail end is at a proximal position to the collection reel 2 (the latter position being shown in FIGS. 1-3). The oscillation of the conveyor belt 23 is indicated, in FIGS. 2 and 3, by arrow B.

The oscillation of the conveyor belt 23 is driven by a pneumatic actuator 24. Such actuator 24 comprises, in particular, a cylinder 25 associated with a crosspiece 26 integral to the support frame 100 and a piston 27 associated with a crosspiece 28 integral to the conveyor belt 23.

In the embodiment shown in FIG. 2, the conveyor belt 23 comprises a pair of parallel belts 231, 232 that can be moved away from/towards each other through two pneumatic cylinders 291, 292. Such cylinders 291, 292 allow the automatic adjustment of the relative position of the two parallel belts 231, 232 according to the width of the elongated element 1 and to the width of the collection reel 2. The reciprocal movement of the two parallel belts 231, 232 is shown in FIG. 2 by the dual arrow indicated on the two belts 231, 232.

In an alternative embodiment not shown, the conveyor belt 23 comprises a single belt mounted in an oscillating way about the pivot axis Fi. The working position of such belt is the closest possible to the collection reel 2 for minimising the free portion of elongated element 1 about to be deposited onto the collection reel 2.

As shown in FIGS. 2 and 3, a detection device 30 is arranged between the conveyor belt 23 and the collection reel 2 for detecting the variation in length of the portion 1' of elongated element 1 about to be deposited onto the collection reel 2. Such portion 1' of elongated element 1 is in the practice defined by the portion of elongated element that projects from the conveyor belt 23.

With reference to FIG. 2, the detection device 30 comprises, in particular, two potentiometers 301, 302 (one at the respective belt 231, 232). The two potentiometers 301, 302 are movable away from/towards each other integrally with belts 231, 232. In case the conveyor belt 23 comprises a single belt, a single potentiometer is used.

Potentiometers 301, 302 (or, alternatively, the single potentiometer) are each connected to a pneumatic actuator 321, 322 comprising a cylinder 331, 332 associated with a crosspiece 341, 342 integral to the conveyor belt 231, 232 and a piston 351, 352 associated with a crosspiece 361, 362 associated with the respective potentiometer 301, 302 (or to the single potentiometer). The pneumatic actuators 321, 322 act on potentiometers 301, 302 (or on the single potentiometer) for detecting the variation in length of the portion 1' of elongated element 1 weighing onto potentiometers 301, 302 (or onto the single potentiometer) and are driven through proportional valves for counterbalancing the weight of potentiometers 301, 302 and of portion 1' of elongated element 1 weighing onto potentiometers 301, 302 (or onto the single potentiometer) as the geometrical dimensions (for example, thickness) and the linear weight of the elongated element 1 vary.

In operation, potentiometers 301, 302 (or the single potentiometer) oscillate about the pivot axis F2, as indicated in FIGS. 2 and 3 by arrow C.

Always with reference to FIGS. 2 and 3, at the conveyor belt 21 apparatus 10 comprises a device 40 for detecting the passage of a tail end of the elongated element 1 during its movement towards the collection reel 2.

Such device 40 comprises two sensors 411, 412 arranged at the sides of the conveyor belt 21 and a roller 42 arranged above the conveyor belt 21. The ends of roller 42 act in thrust towards the detection surfaces of sensors 411, 412. During winding of the elongated element 1 onto the collection reel 2, roller 42 contacts the top surface of the elongated element 1. The direct contact between ends of roller 42 and sensors 411, 412 indicates the passage of the tail portion of the elongated element 1.

The assembly defined by conveyor belt 21, conveyor belt 23 and detection device 30 may shift with respect to the collection reel 2 along the feeding direction A of the elongated element 1. Such shifting takes place under the control of a motor member 45 (FIGS. 1 and 3) suitable seated on a special support crosspiece 101 provided underneath the conveyor belt 21. For simplicity of representation, the motor member 45 and the support crosspiece 101 are not shown in FIG. 2.

As shall appear clearly in the following of the present description, the above shifting takes place according to the actual winding diameter of the collection reel 2, so as to keep the length of the free portion of elongated element 1 projecting from the detection device 30 constant as the aforementioned actual winding diameter varies. The speeds of the input belt 5 and of the conveyor belts 21 and 23 are in turn corrected according to the above shifting, so as not to create undesired strains or accumulation.

Figure 4:
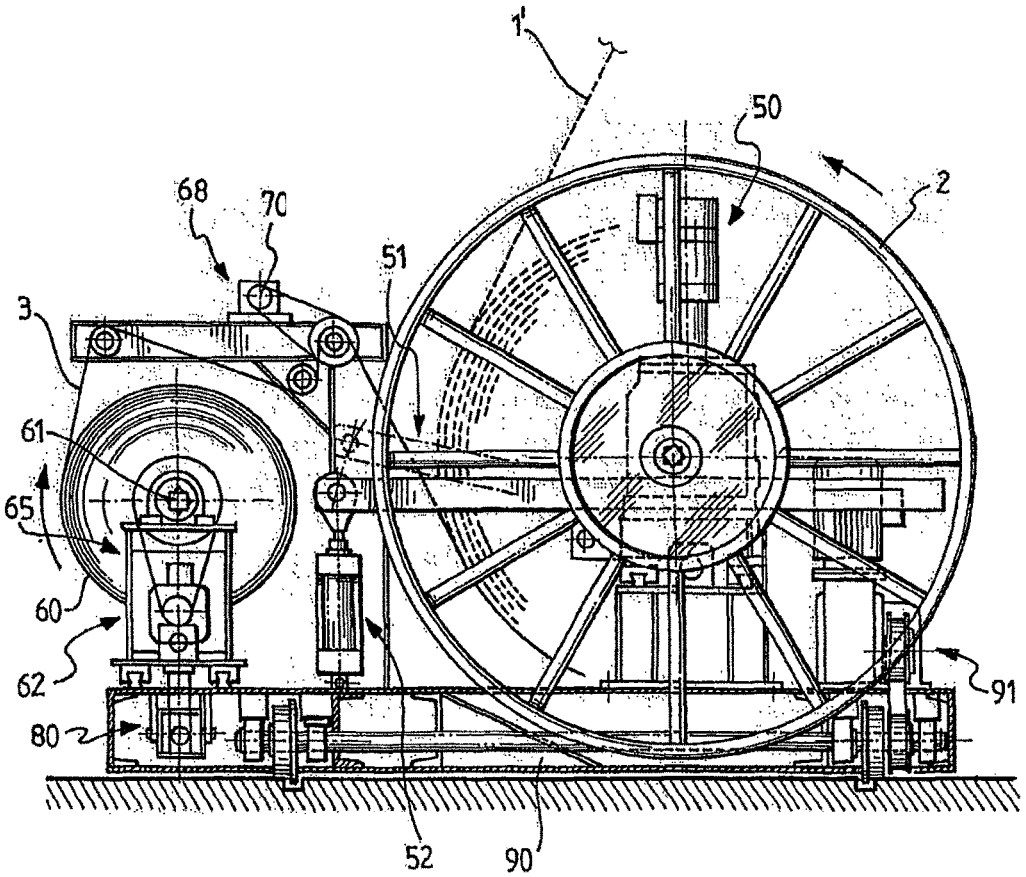
FIG. 4 is a schematic side view of a second portion of the apparatus of FIG. 1.

With reference to FIGS. 1 and 4, the rotation of the collection reel 2 is driven by a specific motor group 50. A lever system 51 (FIG. 4), driven by a specific pneumatic actuator 52, allows lifting the collection reel 2 for bringing it to the working position.

The service fabric 3 is taken from a specific storage reel 60. Such storage reel 60 is mounted close to the collection reel 2 on a square bar 61 which is in turn mounted on a support 62.

The service fabric 3 is unwound from the storage reel 60, and wound onto the collection reel 2, by the pulling action exerted by the latter when driven in rotation.

A motor group 65 acts on the storage reel 60 for commanding a rotation in an opposite direction (or, alternatively, in the same direction but at a reduced speed) with respect to the rotation commanded by the collection reel 2. The motor group 65 then acts as a brake. Such motor group 65 is torque-limited and allows adjusting the braking torque and, as a consequence, the tension of the service brake 3.

Between the storage reel 60 and the collection reel 2 there is a plurality of deviating rollers (generally indicated with reference numeral 68) adapted to bring the service fabric 3 from the storage reel 60 to the collection reel 2.

An encoder 70 adapted to detect the instantaneous linear speed of the service fabric 3 during the winding onto the collection reel 2 is mounted at one of such deviating rollers 68.

Once the instantaneous linear speed of the service fabric 3 is known, it is possible to calculate the instantaneous peripheral speed of the collection reel 2 and, as a consequence, the actual winding diameter of the collection reel 2.

Once the instantaneous linear speed of the service fabric 3 is known, it is further possible to calculate the instantaneous rotation speed of the storage reel 60 and, as a consequence, the actual unwinding diameter of the storage reel 60. It is thus possible to manage and instantaneously control the rotation speed of the collection reel 2 and the tension applied to the service fabric 3 as the winding diameter of the collection reel 2 and the unwinding diameter of the storage reel 60 vary.

The storage reel 60 and the motor group 65 can be moved in crosswise direction with respect to the pulling direction of the service fabric 3 so that the service fabric 3 is pulled onto the collection reel 2 along a predetermined pulling direction. This is done in order to keep the service fabric 3 centred and aligned with the elongated element 1 during the winding onto the collection reel 2. Such crosswise movement is driven by an actuator 80 as a result of the signal generated by a position sensor (not shown) adapted to detect the position of a side edge of the service fabric 3.

The collection reel 2, the storage reel 60 and the relative driving and support members described above are all mounted on a base 90 that can be moved, driven by a special motor group 91, in a crosswise direction with respect to the feeding direction A of the elongated element 1. This is done in order to move it to the reel loading/unloading zone.

The work station 11*a* is totally identical to the work station 11 described above, except as regards the conveyor belt 21*a*, corresponding to the conveyor belt 21 of the work station 11. The other structural components of the work station 11*a* are thus indicated with the same numeral references as the corresponding structural components of the work station 11, with the addition of letter a. For clarity of illustration, only some of such numeral references are shown in FIGS. 1 and 5.

Figure 5:
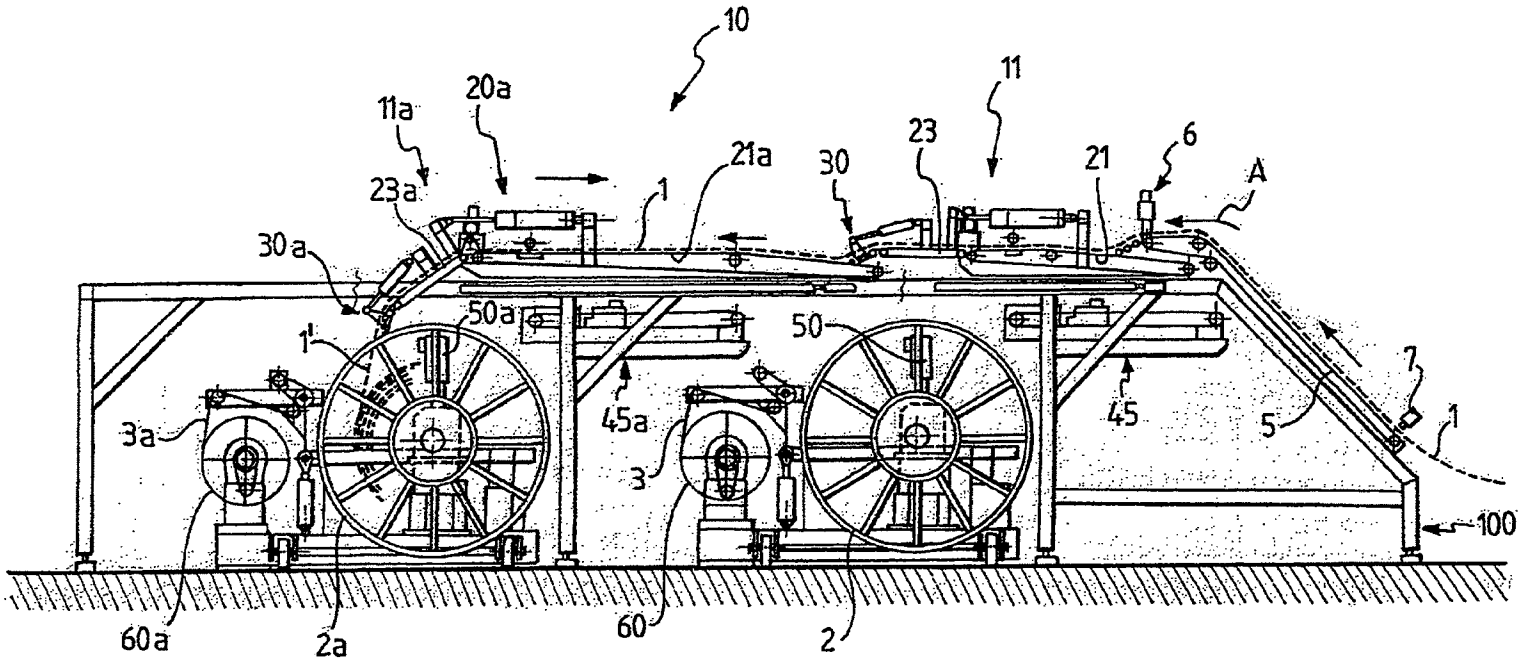
FIG. 5 is a schematic view of the apparatus of FIG. 1 in a different operating configuration.

With reference to FIGS. 1 and 5, the conveyor belt 21*a* has a greater longitudinal extension than that of conveyor belt 21 and can be moved away from/towards the conveyor belt 21 under the control of a specific motor group 45*a* corresponding to the motor group 45 of the first work station 11.

The operation of apparatus 10 is managed by a special control device (not shown). Such control device adjusts the rotation speed of the collection reel 2 according to the actual winding diameter of the collection reel 2 and controls the tension as discussed above.

The method of simultaneous winding of the elongated element 1 and of the service fabric 3 onto the collection reel 2 shall now be described.

In a preliminary step of preparation of apparatus 10, the operator brings the collection reel 2 into the work station 11 rolling it on the ground.

The distance between the opposite levers of the lever system 51 is adjusted according to the width of the collection reel 2. Such adjustment takes place through a specific pneumatic cylinder.

The collection reel 2 is then lifted and moved into the working position by the lever system 51 driven by the pneumatic actuator 52 (FIG. 4).

At that point, the operator winds some turns of fabric service 3 onto the collection reel 2, manually pulling such service fabric 3 from the storage reel 60.

The detection device 30 is disconnected discharging the feeding proportional valve of each pneumatic actuator 321, 322. Potentiometers 301 and 302 (or the single potentiometer) are in this way moved close to the collection reel 2.

The relative position of the two parallel belts 231, 232 of the second conveyor belt 23 is adjusted by actuators 291, 292 according to the width of the collection reel 2 and to the width of the elongated element 1.

The head of the elongated element 1 is then positioned tangent to the core of the collection reel 2. Such positioning is obtained by actuating the motor group 6 adapted to move the input belt 5 and the motor group 22 adapted to move the conveyor belts 21 and 23.

The detection device 30 is then reactivated, charging the feeding proportional valve of each pneumatic actuator 321, 322. Potentiometers 301 and 302 (or the single potentiometer) are in this way lifted up to contacting portion 1' of elongated element 1 that projects from the conveyor belt 23.

The start of the controlled winding of the elongated element 1 and of the service fabric 3 onto the collection reel 2 (configuration shown in FIG. 1 and, more in detail, in FIGS. 2-4) is then driven.

In a starting transient, the collection reel 2 is driven in rotation by the respective motor group 50 at an initial rotation speed calculated according to the initial diameter previously detected by the winding on a portion of only service fabric 3 and according to the linear peripheral speed of the collection reel 2. Such linear peripheral speed is detected by detecting, through the encoder 70, the linear speed of the service fabric 3. The latter is pulled towards the collection reel 2 by rotating such reel, thus winding thereon together with the elongated element 1.

Once the peripheral speed of the collection reel 2 is known, the actual winding diameter of the collection reel 2 is calculated.

In operation after the starting transient, the rotation speed of the collection reel 2 is adjusted, instant by instant, according to the aforementioned actual winding diameter, so that the instantaneous peripheral speed of the collection reel 2 is equal to the instantaneous advancing speed of the elongated element 1. The latter is initially known as a given datum upstream of the input belt 5 and afterwards, it is calculated by the detection carried out by photocells 7 provided onto the same input belt 5.

The rotation speed of the collection reel 2 is further adjusted, instant by instant, by the feedback of the signal generated by the detection device 30 of the variation in length of portion 1' of elongated element 1 about to be deposited. In particular, the rotation speed of the collection reel 2 is increased or decreased according to whether the detection device 30 respectively detects a decrease or an increase in the length of portion 1' of elongated element 1 about to be deposited.

At the same time, the motor member 45 drives the assembly defined by conveyor belt 21, conveyor belt 23 and detection device 30 to make it shifting with respect to the collection reel 2 along the feeding direction A of the elongated element 1, with a motion adjusted according to the actual winding diameter of the collection reel 2, so as to keep the length of the free portion of elongated element 1 projecting from the detection device 30 constant. The speeds of the conveyor belts 21 and 23 are corrected according to the above shifting.

During the winding of the elongated element 1 and of the service fabric 3 onto the collection reel 2, the motor group 65 drives the storage reel 3 in the opposite direction (or, alternatively, in the same direction but at a reduced speed) with respect to the rotation commanded by the collection reel 2, then acting as a brake. Once the rotation speed of the storage reel 3 and its peripheral speed are known (the latter being detected through the encoder 70), the actual unwinding diameter of such reel is then calculated instant by instant.

Once the actual unwinding diameter of the storage reel 60 and the actual winding diameter of the collection reel 2 are known and taking into account the desired tension on the service fabric 3, the torque limit on the motor group 65 is updated so as to control the tension of the service fabric 3 during the entire process.

During the winding of the elongated element 1 and of the service fabric 3 onto the collection reel 2, the storage reel 60 is further moved perpendicularly to the feeding direction A of the elongated element 1 in order to keep the service fabric 3 aligned along a predetermined pulling direction. Such movement is driven by actuator 80 according to the signal generated by a position sensor (not shown) adapted to detect the position of a side edge of the service fabric 3.

Moreover, the base 90 whereon the collection reel 2 and the storage reel 60 are mounted is moved, driven by the motor group 91, in a crosswise direction with respect to the feeding direction A of the elongated element 1. Such crosswise movement moreover, takes place in the initial setting step of apparatus 10 according to the width of the collection reel 2 used, or also in order to move the collection reel out of line in the loading/unloading step, thus facilitating the operator's manual maneuvres.

The winding of the elongated element 1 and of the service fabric 3 onto the collection reel 2 is carried out until sensors 411, 412 generate a respective identification signal of the passage of the tail ends of the elongated element 1. Such signal is generated by the direct contact of the ends of roller 42 (which in operation contacts the top surface of the elongated element 1) with the detection surfaces of sensors 411, 412.

Subsequent to the detection of the above signal, and after a predetermined delay time adapted to allow the completion of the deposition of the elongated element 1 onto the collection reel 2, the detection device 30 and the relevant feedback on the rotation speed of the collection reel 2 are deactivated and the backward shifting of conveyor belts 21 and 23 is driven so as to lay the tail of the elongated element 1 onto the collection reel 2.

The unloading operations of the collection reel 2 and storage reel 60 from the work station 11 are then carried out. Such operations take place according to a procedure opposite that of loading described above.

In the meantime, the conveyor belt 21*a* of the work station 11*a* may be brought to the position shown in FIG. 5 so as to proceed with the winding of the elongated element 1 onto the collection reel 2*a*. Such winding takes place at the same time as that of a service fabric 3*a* collected in a storage reel 60*a* arranged on a side of the collection reel 2*a*.

The setup of apparatus 10 in the operating configuration of FIG. 5 therefore takes place automatically at the end of the winding onto the collection reel 2 of the work station 11 (configuration of FIG. 1), and vice versa.

When the conveyor belt 21*a* is in the working position of FIG. 5, the conveyor belt 23 and the detection device 30 of the work station 11 are in the respective distal positions with respect to the collection reel 2, so that the head end of the conveyor belt 21*a* can position underneath the detection device 30. In this operating configuration, the elongated element 1 bypasses the work station 11 and is fed to the collection reel 2*a*, in order to be wound thereon at the same time as the service fabric 3*a*. Such winding takes place in a way totally similar to what described above with reference to the work station 11. In a specific embodiment of the present invention, in the starting transient the rotation speed of the collection reel 2, 2*a* is comprised between 3 and 45 m/min, while in operation after the starting transient it is comprised between 30 and 45 m/min.

From the above description it is clear that the method and the apparatus of the present invention allow carrying out the simultaneous winding of an elongated element 1 onto a collection reel 2, 2*a* with the interposition of a service fabric 3, 3*a*, carrying out an automatic control of the winding speed and tension of both the elongated element 1 and the service fabric 3, 3*a*. An even winding which is free of tensions is thus obtained when changing the operating conditions, such as for example: thickness and/or width and/or weight/amount of the elongated element 1, diameter and/or width of the collection reel 2, 2*a*. Moreover, it is possible to control the winding of the tail portion of the elongated element 1 and automatically manage the centering of the service fabric 3, 3*a* with respect to the elongated element 1.

Of course, a man skilled in the art can make further changes and variants to the invention described hereinbefore in order to satisfy specific and contingent application requirements, these changes and variants in any case falling within the scope of protection defined by the following claims.

The invention claimed is:

1. An apparatus for winding an elongated element onto a collection reel with an interposition of a service fabric, comprising a first work station comprising:

a device for feeding the elongated element toward the collection reel;

a device for feeding the service fabric toward said collection reel;

a device for driving in rotation said collection reel;

a control device for controlling the rotation speed of said collection reel, wherein said control device comprises:

a device for detecting an actual winding diameter of said collection reel;

a device for adjusting the rotation speed of said collection reel according to said actual winding diameter of the collection reel; and a detection device for detecting a variation in length of a portion of elongated element about to be deposited onto said collection reel, said rotation speed of said collection reel also being dependent upon the variation in length of said portion of elongated element; and at least one actuator which is active on said detection device to counterbalance weight of the detection device and of said portion of elongated element weighing onto said detection device.

2. The apparatus according to claim 1, wherein said device for detecting the actual winding diameter of the collection reel comprises a device for detecting instantaneous peripheral speed of said collection reel.

3. The apparatus according to claim 2, wherein said device for detecting the instantaneous peripheral speed of the collection reel comprises a device for detecting instantaneous linear speed of the service fabric.

4. The apparatus according to claim 3, wherein said device for detecting the instantaneous linear speed of the service fabric comprises an encoder associated with at least one roller capable of being adapted to deviate the service fabric toward said collection reel.

5. The apparatus according to claim 1, wherein said device for feeding the elongated element comprises a first conveyor belt arranged close to said collection reel.

6. The apparatus according to claim 5, further comprising, upstream of said first conveyor belt, at least one device for detecting variation of advancing speed of the elongated element.

7. The apparatus according to claim 5, wherein said first work station further comprises a control device for controlling a relative position of said first conveyor belt with respect to said collection reel.

8. The apparatus according to claim 7, wherein said control device comprises a device for driving movement of said first conveyor belt along a feeding direction of the elongated element.

9. The apparatus according to claim 8, wherein said driving device is operatively connected to said device for detecting actual winding diameter of the collection reel.

10. The apparatus according to claim 5, wherein said device for feeding the elongated element further comprises a second conveyor belt operatively arranged between said first conveyor belt and said collection reel.

11. The apparatus according to claim 10, wherein said second conveyor belt can be moved between a rest position in which a tail end of said second conveyor belt is at a distal position from the collection reel and an operative position in which said tail end is at a proximal position to the collection reel.

12. The apparatus according to claim 11, wherein said first work station comprises an actuator capable of being adapted to drive the movement of said second conveyor belt toward and/or from said collection reel.

13. The apparatus according to claim 10, wherein said second conveyor belt comprises two parallel belts which can be moved toward/away from one another.

14. The apparatus according to claim 13, comprising an actuator capable of being adapted to adjust the relative position of said two parallel belts.

15. The apparatus according to claim 10, wherein said control device for controlling the rotation speed of said collection reel, further comprises:

a device for detecting a variation in length of a portion of elongated element about to be deposited onto said collection reel, said rotation speed of said collection reel also being dependent upon the variation in length of said portion of elongated element, wherein said device for detecting the variation in length is arranged downstream of said second conveyor belt.

16. The apparatus according to claim 1, wherein the service fabric is taken from a storage reel by rotating said collection reel.

17. The apparatus according to claim 16, wherein said first work station further comprises a device for controlling rotation of said storage reel.

18. The apparatus according to claim 17, wherein said control device comprises a device for detecting instantaneous rotation speed of the storage reel and a braking device which is active on said storage reel.

19. The apparatus according to claim 18, wherein said braking device comprises a motor capable of being adapted to apply to said storage reel a rotation in an opposite direction with respect to rotation applied by said collection reel.

20. The apparatus according to claim 16, wherein said first work station comprises an adjustment device for adjusting a relative position of said collection reel and said storage reel.

21. The apparatus according to claim 20, wherein said adjustment device comprises a device for detecting an instantaneous position of the service fabric with respect to the collection reel along a first direction perpendicular to a feeding direction of the elongated element and a device for moving said storage reel along said first direction.

22. The apparatus according to claim 1, wherein said first work station further comprises a device for detecting passage of a tail end of said elongated element during movement thereof toward said collection reel.

23. The apparatus according to claim 1, comprising at least one second work station substantially identical to the first work station and arranged downstream of said first work station with reference to a feeding direction of the elongated element.

24. The apparatus according to claim 23, comprising a device for driving movement of a first conveyor belt of the second work station toward and from the first conveyor belt of the first work station.

25. An apparatus for winding an elongated element onto a collection reel with an interposition of a service fabric, comprising a first work station comprising:

a device for feeding the elongated element toward the collection reel;

a device for feeding the service fabric toward said collection reel;

a device for driving in rotation said collection reel; and a control device for controlling the rotation speed of said collection reel, wherein said control device comprises:

a device for detecting an actual winding diameter of said collection reel, wherein said device for detecting the actual winding diameter of the collection reel comprises a device for detecting instantaneous peripheral speed of said collection reel; and a device for adjusting the rotation speed of said collection reel according to said actual winding diameter of the collection reel.

26. The apparatus according to claim 25, wherein said control device further comprises:

a detection device for detecting a variation in length of a portion of elongated element about to be deposited onto said collection reel, said rotation speed of said collection reel also being dependent upon the variation in length of said portion of elongated element.

27. The apparatus according to claim 25, wherein said device for feeding the elongated element comprises a first conveyor belt arranged close to said collection reel.

28. The apparatus according to claim 25, wherein the service fabric is taken from a storage reel by rotating said collection reel.

29. An apparatus for winding an elongated element onto a collection reel with an interposition of a service fabric, comprising a first work station comprising:

a device for feeding the elongated element toward the collection reel, wherein said device for feeding the elongated element comprises a first conveyor belt arranged close to said collection reel;

a control device for controlling a relative position of said first conveyor belt with respect to said collection reel;

a device for feeding the service fabric toward said collection reel;

a device for driving in rotation said collection reel; and a control device for controlling the rotation speed of said collection reel, wherein said control device for controlling the rotation speed of said collection reel comprises:

a device for detecting an actual winding diameter of said collection reel; and a device for adjusting the rotation speed of said collection reel according to said actual winding diameter of the collection reel.

30. The apparatus according to claim 29, wherein said control device further comprises:

a detection device for detecting a variation in length of a portion of elongated element about to be deposited onto said collection reel, said rotation speed of said collection reel also being dependent upon the variation in length of said portion of elongated element.

31. The apparatus according to claim 29, wherein said device for detecting the actual winding diameter of the collection reel comprises a device for detecting instantaneous peripheral speed of said collection reel.

32. The apparatus according to claim 29, further comprising, upstream of said first conveyor belt, at least one device for detecting variation of advancing speed of the elongated element.

33. The apparatus according to claim 29, wherein said control device comprises a device for driving movement of said first conveyor belt along a feeding direction of the elongated element.

34. The apparatus according to claim 29, wherein said device for feeding the elongated element further comprises a second conveyor belt operatively arranged between said first conveyor belt and said collection reel.

35. The apparatus according to claim 29, wherein the service fabric is taken from a storage reel by rotating said collection reel.

36. An apparatus for winding an elongated element onto a collection reel with an interposition of a service fabric, comprising a first work station comprising:

a device for feeding the elongated element toward the collection reel;

a device for detecting passage of a tail end of said elongated element during movement thereof toward said collection reel;

a device for feeding the service fabric toward said collection reel;

a device for driving in rotation said collection reel; and a control device for controlling the rotation speed of said collection reel, wherein said control device comprises:

a device for detecting an actual winding diameter of said collection reel; and a device for adjusting the rotation speed of said collection reel according to said actual winding diameter of the collection reel.

37. The apparatus according to claim 36, wherein said control device further comprises:

a detection device for detecting a variation in length of a portion of elongated element about to be deposited onto said collection reel, said rotation speed of said collection reel also being dependent upon the variation in length of said portion of elongated element.

38. The apparatus according to claim 36, wherein said device for detecting the actual winding diameter of the collection reel comprises a device for detecting instantaneous peripheral speed of said collection reel.

39. The apparatus according to claim 36, wherein said device for feeding the elongated element comprises a first conveyor belt arranged close to said collection reel.

40. The apparatus according to claim 36, wherein the service fabric is taken from a storage reel by rotating said collection.

41. An apparatus for winding an elongated element onto a collection reel with an interposition of a service fabric comprising a first work station comprising:

a device for feeding the elongated element toward the collection reel;

a device for feeding the service fabric toward said collection reel;

a device for driving in rotation said collection reel; and a control device for controlling the rotation speed of said collection reel, wherein said control device comprises:

a device for detecting an actual winding diameter of said collection reel; and a device for adjusting the rotation speed of said collection reel according to said actual winding diameter of the collection reel;

at least one second work station substantially identical to the first work station and arranged downstream of said first work station with reference to a feeding direction of the elongated element; and a device for driving movement of a first conveyor belt of the second work station toward and from the first conveyor belt of the first work station.

42. The apparatus according to claim 41, wherein said control device further comprises:

a detection device for detecting a variation in length of a portion of elongated element about to be deposited onto said collection reel, said rotation speed of said collection reel also being dependent upon the variation in length of said portion of elongated element.

43. The apparatus according to claim 41, wherein said device for detecting the actual winding diameter of the collection reel comprises a device for detecting instantaneous peripheral speed of said collection reel.

44. The apparatus according to claim 41, wherein said device for feeding the elongated element comprises a first conveyor belt arranged close to said collection reel.

45. The apparatus according to claim 41, wherein the service fabric is taken from a storage reel by rotating said collection.

* * * * *